United States Patent [19]

Saul

[11] 4,124,426

[45] Nov. 7, 1978

[54] METHOD AND APPARATUS FOR PRODUCING A COLLAPSIBLY FOLDABLE PACKAGING SLEEVE HAVING A POLYGONAL CROSS-SECTION

[76] Inventor: Franz J. Saul, Guerzenicher Strasse 61, 5160 Dueren, Fed. Rep. of Germany

[21] Appl. No.: 669,841

[22] Filed: Mar. 24, 1976

[30] Foreign Application Priority Data

| | | | |
|---|---|---|---|
| Mar. 25, 1975 | [DE] | Fed. Rep. of Germany | 2538866 |
| Mar. 25, 1975 | [DE] | Fed. Rep. of Germany | 2538867 |
| Jan. 19, 1976 | [DE] | Fed. Rep. of Germany | 2601723 |

[51] Int. Cl.[2] ..... B65H 81/00

[52] U.S. Cl. ..... 156/193; 93/58 ST; 93/94 PS; 156/194; 156/195; 156/198; 156/443

[58] Field of Search ..... 156/198, 204, 226, 227, 156/196, 199–201, 207, 194; 93/58 ST, 58.1, 58.2, 94 PS, 80 R

[56] References Cited

U.S. PATENT DOCUMENTS

| | | | |
|---|---|---|---|
| 3,610,115 | 10/1971 | Rose et al. | 93/58 ST X |
| 3,619,863 | 11/1971 | Ciabani | 93/94 PS X |
| 3,732,790 | 5/1973 | Miyake et al. | 156/207 X |
| 3,910,171 | 10/1975 | Reinhardt et al. | 93/94 PS X |

*Primary Examiner*—David A. Simmons
*Attorney, Agent, or Firm*—William G. Rhines

[57] ABSTRACT

The present invention provides a method and an apparatus for producing a packaging sleeve of polygonal cross-section, particularly adapted to be foldably collapsed, wherein circular or tubular sleeve stock is formed on a stationary spindle or mandrel from a plurality of glued, thin layers of paper, fabric, plastic material or the like, wound or wrapped one over the other. The sleeve is thereafter shaped into a polygonal cross-section. During the shaping of the tubular packaging sleeve while it is in the glue-wetted state, at least one continuous folding edge impressed into the sleeve wall and extending in the longitudinal direction of said sleeve is press-formed at the desired longitudinally extending edge corners of the polygonal cross-section. The sleeve, wrapped to a final wall thickness after the winding or wrapping operation, is subjected, in the form of individual, separated sections or lengths, to a shaping operation to form a polygonal cross-section at a separate rate of feed, simultaneously with the formation of the folding edges.

18 Claims, 26 Drawing Figures

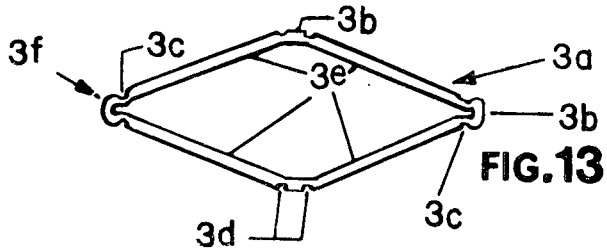
FIG. 13
FIG. 17
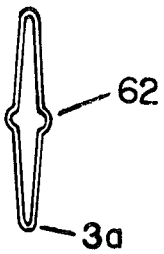
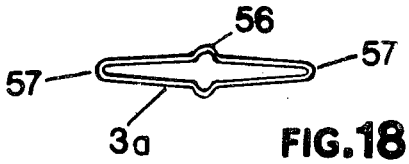
FIG. 18
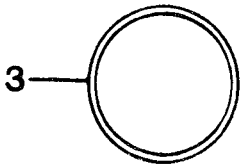
FIG. 19

METHOD AND APPARATUS FOR PRODUCING A COLLAPSIBLY FOLDABLE PACKAGING SLEEVE HAVING A POLYGONAL CROSS-SECTION

RELATED APPLICATIONS

This Application is a continuation-in-part of Copending Application No. 579,058, filed May 20, 1975, now U.S. Pat. No. 4,120,323.

BACKGROUND OF THE INVENTION

Packaging sleeves of polygonal cross-section ("polygonal packaging sleeves"), especially such having a rectangular or square cross-section, provide very substantial advantages as compared with conventional circular packaging sleeves, such as savings in space, improved stackability (as rolling away is avoided), avoiding of a bulk freight extra charges, etc.

Packaging sleeves which not only have a polygonal cross-section, but which, moreover, are adapted to be folded at their longitudinal edges, and so may assume a flat state in their empty condition, further substantially reduce the space required in their empty condition, namely to about 1/11 of the polygonal cross-section to which they can be expanded. Owing to this advantage, collapsible or foldable packaging sleeves may be sent in their empty condition to geographically remote markets, making greater production units possible and storage greatly simplified. Besides, certain other operations (hole punching, etc.) can be performed more readily when the sleeves are in the flattened condition.

In the proposed method of production according to the parent application No. 579,058, a positive co-rotation of the shaping tools, i.e. of the mandrel or spindle shaping the polygonal cross-section and, optionally, simultaneously pressing longitudinal grooves into the sleeve wall, may place certain limitations on increases in the rate of production. Besides, easy rotatability of the shaping mandrel requires a more complicated apparatus than might a fixed, or non-rotating mandrel. Further, spiral wrapping or winding operations frequently require a different feeding power than for the shaping into the polygonal cross-section.

The present invention comprises methods of producing a collapsibly foldable packaging sleeve of a polygonal cross-section whereby circular or tubular sleeve stock is formed on a stationary spindle or mandrel from a plurality of glued thin layers of paper, fabric, plastic material or the like, wound or wrapped one over the other. The sleeve is thereafter shaped into a polygonal cross-section. During the shaping of the tubular packaging sleeve in the glue-wetted state, at least one continuous folding edge is impressed into the sleeve wall extending in the longitudinal direction of said sleeve and is press-formed at the desired longitudinally extending edge corners of the polygonal cross-section. This invention is also embodied in an apparatus for carrying out such methods including a stationary wrapping spindle or mandrel upon which the wrapping material may be wound or wrapped, which joins a second mandrel for coaxially receiving said sleeve and which continuously forces said sleeve into the polygonal configuration by enlarging its cross-sectional area, said mandrel being equipped with at least two opposing series or rows of grooving rollers, the projected center planes of which intersect the axis of the second mandrel and which grooving rollers each have an edge impressed into the sleeve wall; said grooving rollers diverging outwards, sequentially from the starting end of said second or polygonally shaping mandrel for a distance such that they reach a radial spacing relative to each other corresponding approximately to the interior diagonal lines of the desired polygonal cross-section.

By means of this method, the sleeve wall may be wound or wrapped in the form of continuous, spirally wrapped sleeve stock which is divided into individual lengths of sleeve, or the sleeve wall may be wound transversely in parallel fashion such that sleeve sections of limited length are formed.

Accordingly, it is the object of the present invention to avoid or minimize prior art limitations and, more particularly, to provide not only improved production, but also means for producing a wide variety of packaging sleeves, while at the same time simplifying the tools used and producing a flattened sleeve in a single operation.

SUMMARY OF THE INVENTION

Desired objectives may be achieved through practice of this invention in accordance with embodiments of which sleeve stock wrapped to a final wall thickness after the winding or wrapping operation, is subjected, in the form of individual separated sections or lengths, to a shaping operation to form a polygonal cross-section simultaneously with the formation of the folding edges at a feed rate different from that at which the sleeve Stock is formed.

Moreover, since the shaping step can be performed by a roll instead of by grooving to form a polygonal foldable sleeve, with this invention it is also possible to produce non-foldable sleeves of polygonal cross-section because instead of the grooving operation, the circular or tubular packaging sleeve is subjected to a radially outwardly directed roll shaping operation in the longitudinal direction of the sleeve, in the region where corners of the polygonal cross-section are desired. Such roll shaping is preferably performed in a plurality of sequential or successive roll shaping steps, each of which are along successively radially increased interior diagonal lines of the polygonal cross-section.

Particularly in the case of short final lengths of the sleeves, it is possible for the separated sections or lengths to be so dimensioned as to be multiples of the final lengths to be produced, i.e. at least twice the final length, so that such sections may be severed (cut) into the final length sections after the operations of shaping into the polygonal cross-section and formation of the folding edges, i.e. into so-called "useful sections".

In the continuous production of the packaging sleeves by spiral wrapping, where the sleeve stock, prior to the shaping of the polygonal cross-section, is continuously cut into individual lengths which are thereafter subjected on one and the same longitudinal axis, and with a different rate of feeding, to the shaping of the desired polygonal cross-section and, optionally, to the impressing of corner grooves, the respective length may be advanced independently of the rotation of the spindle, there not being a driving component in the direction of rotation, without thereby being compelled to discontinue the continuous flow of production. Owing to the progressive softening induced by the glue or adhesive liquid used in the wrapping operation, optimum shaping characteristics for the longitudinal grooving and also for a optimal longitudinal rolling may be obtained. In any case, substantial increases in the rate of production can be obtained.

By this method, it is also possible to polygonally shape and fold parallel-wrapped sleeves in the same way immediately after the wrapping operation, if a stationary shaping tool is rotatably embedded into the end of the parallel wrapping spindle or mandrel.

An important step of production made possible by this invention is that the final sleeves being shaped into a polygonal cross-section from the inner sides thereof and provided with folding edges in the form of impressed longitudinal grooves, may immediately thereafter be subjected to a folding operation in at least one direction parallel to the longitudinal axis of each of said sleeves, whereby said sleeve is brought into a configuration being folded flat. In order to provide for easy foldability, the sleeves should each be folded successively at different longitudinal corners.

Particularly in the case of a sleeve having a rectangular cross-section, according to the present invention sleeves may be sequentially formed initially into an edgewise upright, folded cross-section and thereafter into a flatly positioned, folded (collapsed) shape.

In the interest of automating and simplifying production, sleeves during the successive folding operations may be guided on guide means passing longitudinally through the interior thereof.

In this way, the polygonally shaped sleeve lengths or sections may be folded, unfolded and counterfolded or cross-folded in successive and independent steps. By this means, without any extra operations, a flattened sleeve which may re-assume its polygonal shape simply by exerting finger pressure against the lateral sleeve edges may be produced. By means of a cover inserted into the end openings, particularly in recessed fashion, or by means of a correspondingly punched out flap closure, the sleeve may be given a stable polygonal shape again.

Due to the sleeves being discharged from the machine in a flattened condition, they are already prepared for possibly subsequent processing steps, such as dividing or severing (if individual sections of the sleeve stock and no final lengths of sleeve are initially processed), punching, slicing, etc.

During the grooving operation, a particularly positive and controllable force action upon the sleeve may be obtained if the sleeves are provided at their edges with a groove impressed into the sleeve wall from the interior outwards, and, on the outer side, with corresponding opposite depressions on both sides of such groove. This also serves to improve the stretching of the flat sides of the sleeves into a straight condition.

Apparatus in accordance with the present invention may be of substantially simplified construction, since, as previously noted, the process starts with a stationary wrapping spindle or mandrel upon which the wrapping material may be wound or wrapped and which joins a mandrel for coaxially receiving the sleeve and continuously forces it into a polygonal configuration by enlarging its cross-sectional area, and the mandreal for polygonally shaping the sleeve is equipped with at least two diametrically opposite rows of grooving rollers diverging outwards proceeding from the starting end of the shaping mandrel until they reach a relative radial spacing corresponding approximately to the interior diagonal lines of the polygonal cross-section, each of which grooving rollers has an edge impressing into the sleeve wall and the projected center planes of which intersect the axis of the mandrel. More particularly, apparatus according to the invention is characterized in that a mandrel for polygonally shaping said sleeve, such as said wrapping spindle or mandrel, is stationary, and that between said wrapping mandrel and said shaping mandrel is positioned a severing or cutting means for cutting partial lengths or sections from the sleeve, separate driving means being provided for said severed partial lengths or sections.

In order to carry out the folding operations, the stationary shaping mandrel is followed by a first folding station. For repeated folding steps, the first folding station may be followed by at least one further folding station which folds or collapses the foldable sleeve in a given direction different from that of the first folding station, along longitudinal edges, whereby each folding station is preceded by means for unfolding the sleeve from the previously folded condition.

It has been found to be of particular advantage for trouble-free and automatic production if the apparatus includes guide means extending continuously from said shaping mandrel to the final folding station, said guide means passing through the interior of said sleeve relative thereto, and wherein optimally said individual folding stations include separately driven pairs of rolls between which the folding operation is effected which are provided, preferably in a mid-portion thereof, with a recess through which said continuous guide means may pass. The guide means may consist of a thin, rigid metallic wire. Advantageously, it is possible for said means for unfolding said sleeve to be a conical body that is widest in the direction of advance of said sleeve and is mounted to said guide means.

Also, according to the present invention, the folding stations maybe formed in such manner that at least one of them is preceded by a pair of guide or baffle faces forming an infeed funnel which is aligned to the slot or gap between said pairs of rolls which perform the folding operation.

The severing device between the circular wrapping or winding of the spiral sleeve and the polygonal shaping may comprise an electronically controlled saw moving along with the cutting plane on the sleeve stock, or a circular saw. Both methods of severing are presently already used in the severing of thin-walled sleeves.

The independent drive means may include a pair of synchronously driven conveyor rolls engaging the outer surface of the sleeve with friction, or cylindrical, profile conveyor rolls, whereby additional backing rolls may be provided interiorly of the sleeve.

In order to provide for as rapid as possible a rearrangement to various cross-sections without having to use additional tools, it is of particular advantage if the series of grooving rolls mounted to the mandrel are radially adjustable. In this construction, either the pitch alone or all of the rolls, comprising a series may be mounted to be radially adjustable on the mandrel.

In addition and if necessary, the backing rolls arranged on the outer face of the sleeve may be correspondingly adjustable, whereby adjustability of the inner and outer rolls in combination provides for advantages in rearrangement or conversion.

A particularly favorable and, as compared with the above-mentioned method, more economical modification of the method which makes it possible to obtain still higher rates of production, resides in the fact that wrapped sleeve stock, after its separation into individual lengths and while in a still moist condition from the glue or adhesive, is subjected to a press-forming operation, during which the sleeve is compressed or flattened from the circular or tubular configuration directly into a flattened configuration (i.e., with the interior of the sleeve walls contacting each other), thereby forming sharp bending edges or folds at the edges of the flattened sleeve wall. The sleeve is thereupon unfolded again and flattened or compressed in at least one subsequent pressing station in an angular position different from that in the preceding press shaping step. Thus, the periphery of said sleeve is shaped by the successive compression of flattening steps into substantially planar surfaces, interconnected at their longitudinal edges and defining a polygonal cross-section of said sleeve when the latter is unfolded.

Thus, in contrast with previously proposed methods it has been found to be sufficient that the wrapped sleeve material, in accordance with the method of the invention, is simply deformed from the circular cross-section, while still wet from the adhesive, at the longitudinal edges or corners and into the flat faces of a polygonal cross-section of the sleeve. In addition, there is the advantage that the flat faces are thereby subsequently compressed and compacted, whereby permanently foldable longitudinal edges are formed at the compressed edges which show superior tear strength even at a later point in time when in a dry condition.

In this method, it is advantageous for the first and/or the second press shaping or forming steps to be performed as rolling operation(s), in the course of which the sleeve is initially compressed into a flat cross-section at its leading front end, and thereafter passed through a pair of rolls in the direction of the longitudinal axis of said sleeve, whereby the sleeve is successively compressed along its full length with flatly contacting sleeve walls. By this means, the unfolding step intermediate said first and second press forming steps is performed successively or continuously during transfer of the sleeve from the first to the second compression station.

In another embodiment of the invention, in order to produce a sleeve having a square cross-section, the first and second press forming steps are performed under an angle of 90° to each other.

A wider variety of dimensional combinations maybe easily obtained if, in order to produce a sleeve having a rectangular cross-section, said first and second press forming steps are performed under an angle different from 90°. By this means, simplified production is obtained in that during said first and/or second press forming steps, a bulge is impressed into the sleeve wall in at least one of the sleeve wall portions pressed against each other, which bulge is convexly curved outwards and which extends in parallel with the longitudinal axis of the sleeve and along one of the contemplated folding edges of the sleeve.

Improved quality of the longitudinal edges formed by the above-described method through avoidance of irregular compressed folds may be obtained in that during the press forming step, recessed longitudinal grooves are impressed into the sleeve wall along at least one of the longitudinal edges of the polygonal cross-section to be provided, and whereby, one longitudinal groove each is impressed on either side adjacent a longitudinal edge.

A decided technical advance is obtained by a mode of operation of the invention wherein said longitudinal grooves are each impressed from the outer side into the sleeve wall during a press forming step at the upper and lower sides of the marginal pressed edges.

More particularly, the grooving operation in the case of a four-corned or rectangular or square cross-section may be performed in a single grooving method step wherein longitudinal grooves are impressed for all longitudinal edges or corners into the sleeve wall during the first press forming or shaping step, and wherein the longitudinal grooves which are not positioned adjacent the pressed edges, are impressed into the outer surface of upper and lower side of the flat faces of the sleeve wall in the form of juxtaposed dual grooves.

Thereby, optimum longitudinal edges which may repeatedly be folded can be obtained by the paired, associated longitudinal grooves being impressed with a relative spacing corresponding at least to the thickness of the sleeve wall.

It has been found to be advantageous for the press shaping to be performed between two pairs of rolls, with the formation of the longitudinal grooves being effected by raised grooving edges or rims provided on the roll surface.

Apparatus particularly advantageous for carrying out the above-mentioned method, is characterized in that a first pressing stage or station is provided which includes a pair of rolls, between which an initially circular or tubular sleeve strand is tightly compressed in one transverse direction by forming a pair of pressed edges therein, wherein said first pressing stage has provided at the downstream end thereof at least one further pressing stage including a pair of rolls adapted to compress or flatten said sleeve in a different position, (e.g. rotated by 90°), and wherein means for unfolding the folded configuration resulting from the respectively preceding pressing stage is provided between said two pressing stages.

Advantageously, apparatus according to the present invention may be constructed in such a manner that the press rolls of at least one pressing stage or station have provided in the pressing face thereof an annular recess disposed around the longitudinal center axis and interiorly of said sleeve, and a stationary, wire-shaped guide means, preferably made of steel, that passes through said recess.

Formation of folding edges or folding hinges can be obtained at the longitudinal edges of the sleeve if outer grooving discs are positioned with a spacing from the outer edge of said pressed edge or corner which corresponds at least to the thickness of the sleeve wall, and wherein inner grooving discs are correspondingly spaced from each other.

For cross-sections having side faces of different width, the inner grooving discs, in the case of a non-square cross-section of the sleeve, each have associated therewith a backing surface on the respective opposite portion of the other roll.

So that the sleeve after the respective preceding press shaping steps can be automatically unfolded, either for another compression step or for finishing, there may be provided a wire-shaped guide element of metal, preferably steel, positioned within said sleeve and on which, following the grooving roll processing means, a conical body is disposed having the point of the cone directed rearwards, as a means for unfolding the compressed sleeve.

The wire-like guide element, comprising a round piece of metal, (preferably steel), is precisely centered during the compression step in a square sleeve; that is, between the upper and lower grooving edges or discs. Therefore, during the compression step, such a guide element presses a slight bulge from the inner side of the sleeve wall in the upper and lower directions, which bulge, at the same time, provides for improved hinge action and for reinforcement of the edge formation.

Methods and apparatus according to the present invention make it possible to produce, in easy manner and with high rate of production, foldable polygonal sleeves, and, additionally, result in improved sleeves having increased strength due to the compression operations and more favorable stiffness because of the longitudinal edges formed with reinforced configuration. Such sleeves may be stored or transported in the folded condition immediately after production and optional drying, or they may be assembled into polygonal wrapped sleeve packaging containers by mounting in the end openings thereof recessedly inserted covers. Alternatively, the sleeves first may be cut to their final length in flattened condition from longer sections and/or subjected to punching operations (perforating, slit formation, etc.).

An advantageously modified apparatus according to the invention for producing wrapped or packaging polygonal sleeves resides in a construction wherein the first pressing stage at least is preceded by an aligning or directing means having at least a part thereof positioned interiorly of said sleeve strand, said means being supported by a preceding or upstream centering means (e.g. a wrapping mandrel) and said means widening in the plane of the gap between the respective subsequent pair of rolls, diametrically across the transverse dimension of the advancing sleeve section.

According to the invention, it is advantgeous that said aligning or directing means comprises a flat metallic plate positioned approximately in the plane of the roll gap between the following pair of rolls and having sides which diverge conically towards said rolls. Such aligning means, in a special embodiment, may be combined with a pair of aligning rollers or aligning skids positioned in the area of said aligning means towards said pair of rolls exteriorly of said sleeve section and equally spaced on either side of the center travel line through said pair of rolls, wherein the total spacing of the separate aligning rollers with respect to each other corresponds approximately to the width of the compressed, flattened sleeve section.

In this construction, the present aligning or directing means interiorly of the sleeve in general does not perform the complete shaping of the circular sleeve portions, but rather a traditional pre-orienting or pre-deformation, for example, into an elliptically preshaped cross-section, sufficient to ensure reliable engagement and compression between the respective immediately subsequent pair of rolls.

The actual or proper centering of the infeed between the rolls may take place in combination with the outer pair of aligning rollers. Since the aligning means interiorly of the sleeve is not stressed to produce the maximum degree of shaping, no damage is caused to the inner side of the sleeve wall. Further, the aligning means may be formed with relatively light weight and thinner metallic plate, and is subject to minimum wear.

Likewise, it is not necessary with the aligning means according to the invention to rearrange or convert the apparatus for every variation of dimensions, because each aligning means may be used for a wider range of dimensions.

The invention also contemplates the feature that the aligning or directing means positioned interiorly of said sleeve section in front or upstream of the pressing stage succeeding the first pressing stage, may be rotated through an angle, for example of 90° in the case of a rectangular cross-section sleeve, about the center travel line, and supported by a wire-like or rod-like means which, in the center travel line, passes through a pair of recesses of the preceding rolls and is mounted to the preceding or upstream aligning means.

The double, centered fold formation within the pair of recesses around the rod-shaped or wire-shaped means for supporting the aligning means as obtained by the apparatus according to the invention, normally is of excellent effectiveness in providing neatly folded edges of the polygonal sleeve.

Finally, simplified and improved guiding of the sleeve portions through the compression stages makes it possible to produce increased pressure between the press rolls, whereby further improved glueing of the individual paper sheet wrapping layers is obtained.

In order to provide or facilitate precisely centered guiding of the sleeves, it is also of importance that a radially and angularly movable aligning joint be provided at least beween said first aligning means and said centering means.

A substantial improvement of the drive assembly for the individual sleeves resides in the fact that between the aligning joint and the centering means, there may be driving means combined with a cutting saw for severing individual sleeve portions or lengths from elongated sleeve stock. Such driving means includes a pair of rollers engaging the sleeve from its outer side, and a back up or backing element positioned intermediate the pair of rollers interiorly of the sleeve, wherein a guide block has, in its portion adjacent said saw, a cutout to provide for free engagement of the saw into the sleeve wall.

DESCRIPTION OF THE DRAWINGS

The present invention may be understood from the following description and the accompanying drawings, wherein:

FIG. 13 is an end view of a sleeve produced according to the invention, after the first processing stage;

FIG. 17 is a cross-sectional view of the product along lines A—A in FIG. 16;

FIG. 18 is a cross-sectional view of the product along lines B—B in FIG. 16; and FIG. 19 is a cross-sectional view of the product along lines C—C in FIG. 16.

DESCRIPTION OF PREFERRED EMBODIMENTS

Although the following as explained by referring to FIGS. 1 to 7, refers to methods of producing polygonal sleeves from a spirally wound or wrapped sleeve strand 1, the fundamental features of methods could as well be applied to a parallely wrapped sleeve strand whereby, instead of a continuous sleeve strand 1, a parallely wrapped sleeve strand of limited length is subjected to further processing.

Figure 1:
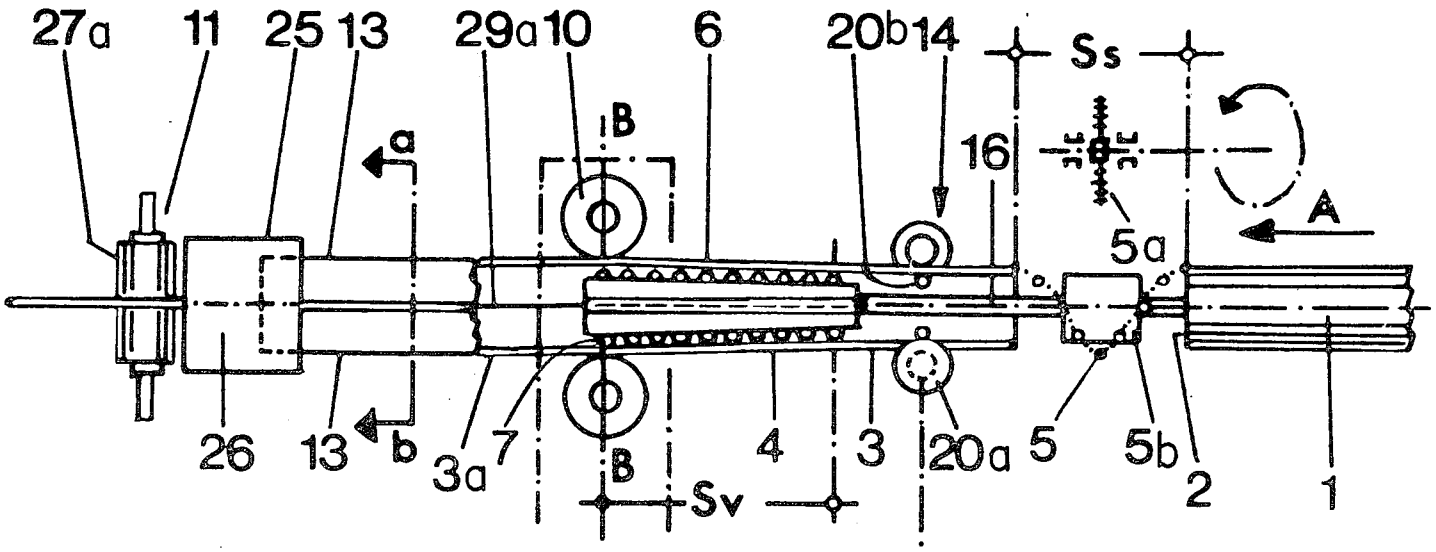
FIG. 1 is a schematic view of an embodiment of this invention.

As shown in FIG. 1, sleeve stock 1, wrapped in helical or spiral fashion on a stationary wrapping spindle or mandrel 2, is fed to the subsequent production line by means of the feeding motion produced during the spiral wrapping in the direction of arrow A, whereby the sleeve strand 1 rotates continuously e.g. in the direction of arrow B.

As soon as a given portion of sleeve stock 1 has advanced in the direction of arrow A, this section or length is severed from the stock as sleeve 3 along the severing path $S_s$ of saw 5*a* by means of a neat, fiber-free severing cut 5 on a wooden spindle or mandrel. The severed sleeve 3 is thereafter engaged by drive means 14 which, as FIGS. 4 and 5 also show, comprises outer conveyor rollers 20*a*, each having a concave surface configuration, which contact with frictional engagement the outer periphery of the still circular or tubular sleeve 3. A set of knobbed or camber bowed inner rollers 20*b* may be positioned interiorly of the tubular sleeve 3, which rollers serve to back up the sleeve wall from the inner side against the pressure exerted by the conveyor rollers thereby preventing the sleeve wall from becoming collapsed. By means of a common bevel gear drive assembly or the like, conveyor rollers 20*a* are driven synchronously, and preferably at a significantly higher rate of conveying speed of sleeve 3 than the rate of feeding of the sleeve stock 1.

The wooden mandrel 5*b* and the following or subsequent inner rollers 20*b* are mounted against rotation at the front end of the wrapping mandrel 2 by means of a supporting rod 16. The severing device or saw 5*a* may be controlled by a light barrier, and it may include a, preferably electronic, positive drive means so as to provide for severing of the sleeve 3 from sleeve strand 1 without any obstruction.

Finally, the supporting rod 16 has attached thereto, likewise mounted against rotation, a spindle or mandrel 4 on which the circular or tubular sleeve 3 is shaped into a polygonal cross-section, preferably a rectangular or square profile. To this end, the corner or edge positions of the polygonal profile of sleeve 3*a* each have mounted thereat series of grooving rollers 6, whereby those grooving rollers 6 upon which the circular sleeve 3 is initially slid by means of drive assembly 14, have such a spacing between the outermost edge of one grooving roller and the outermost edge of the diametrically opposite grooving roller as corresponds to the circular diameter of sleeve 3. In the direction of movement of sleeve 3, this spacing in the grooving rollers 6 increases gradually until at the last grooving roller 7 it reaches a value corresponding to the diagonal line of the polygonal cross-section of the sleeve 3*a* being pre-shaped in this manner.

Accordingly, the initially circular sleeve 3 is shaped into polygonal cross-section across path $S_v$ at the shaping station by being pushed onto the stationary spindle or mandrel 4 by means of said drive assembly 14. Minimum friction is produced because of the use of rollers as shaping tools, so as to prevent either wrinkles or distortions of the surface layers at the inner side of the sleeve in the region of the shaped longitudinal edges or corners 13.

In the region of the processed cross-section B (compare also FIGS. 2 and 3) backing rollers 10 are provided at the outer side of sleeve 3*a* so as to oppose the grooving rollers 7, which backing rollers may also be driven separately. While the grooving rollers 7 on mandrel 4 each impress a notch-like groove 34*a* into the sleeve wall at the inner corners of longitudinal edges 13, the counter or backing rollers 10 each impress corresponding outer grooves 34*a* into the outer side of the sleeve wall.

Figure 2:
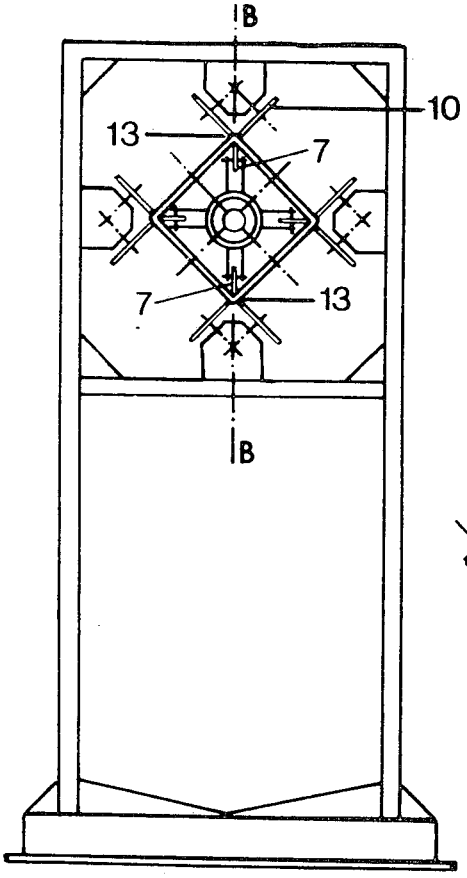
FIG. 2 shows a stationary notching or grooving unit comprising inner rolls and outer rolls, in the location of center line B—B of FIG. 1.
Figure 3:
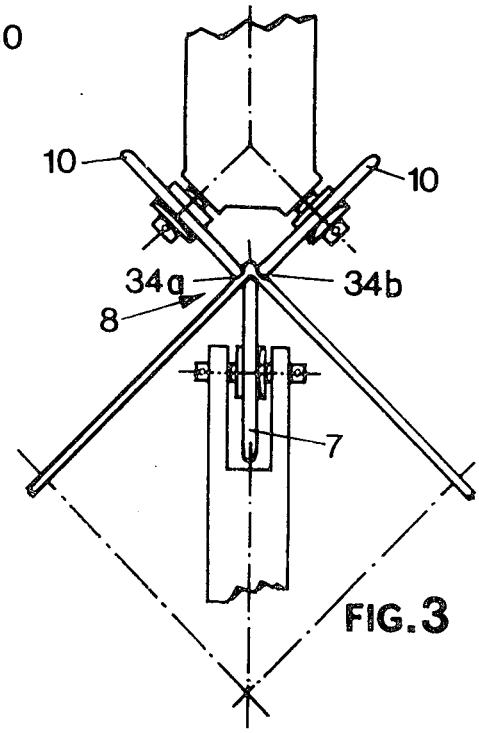
FIG. 3 is an enlarged part view of FIG. 2 showing one unit of inner and outer rolls each.
Figure 4:
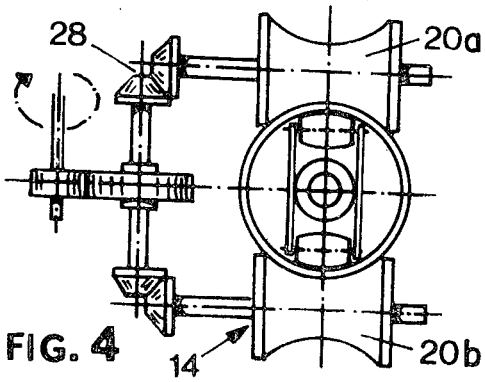
FIG. 4 shows a portion of an embodiment of this invention.
Figure 5:
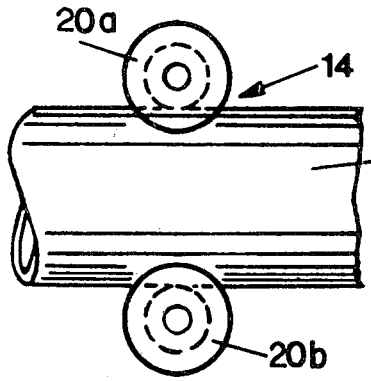
FIG. 5 is a wide elevational view of the unit according to FIG. 4.

If the backing rollers 10, as shown in FIGS. 2 and 3, are angularly positioned relative to the center plane of grooving rollers 7 such that these backing rollers are dispoed approximately perpendicularly to the respective flat sides of the polygonal profile, the combined impressing action of grooving rollers 7 and backing rollers 10 results in a deformation or shaping of the longitudinal edge of sleeve 3*a* while in the glue-wetted condition such that a positive, load bearing folding hinge is provided in the final, dry state of the sleeve. Furthermore, the additionally formed "head" 27*c* along the longitudinal edge has an extra stabilizing effect on the longitudinal edge of the sleeve. A longitudinal edge provided with notches or grooves in this way is always formed smooth, i.e. without wrinkles and without partial separation of wrapping layers.

It is not necessary that the grooving rollers 6, which are serially positioned one behind the other on the deforming mandrel 4, each have a roller profile which results in the formation of a groove. Rather, these rollers also may have a roller edge of slightly larger radius. If, in this way, longitudinal edges having curved radii are only produced by such rollers including grooving roller 7, while backing rollers 10 likewise do not impress grooves into the sleeve wall, a polygonal sleeve results which although it is not foldable, it is finished as soon as it leave station B—B.

In order to allow for a broadened range of variation with respect to the dimensions of the cross-section of the polygonal sleeve, the series of grooving rollers, or the individual grooving rollers, or their pitch may be adjustable radially, whereby the backing rollers 10 must be radially movable, too, in corresponding fashion.

For the further production of foldable sleeves 3*a* of polygonal cross-section, a sleeve 3*a*, grooved in the grooving station B—B of FIGS. 2 and 3 and shaped into a polygonal profile, is fed to a first folding station 11 which, for example, by means of a pair of guide or baffle plates 25 passes the polygonally shaped sleeve 3*a* through a shaping funnel 26 into the gap or nip between a pair of conveying rolls 27*a* and 27*b* between which rolls said sleeve 3*a* is pressed into a flat state in one direction. This flat rolling step at the same time contributes to the bonding operation between the wrapped layers. Downstream of the press nip defined by rolls 27*a* and 27*b*, the sleeve 3*a* has imparted the final configuration in which it is flatly compressed, i.e. flattened in one direction.

Figure 1A:
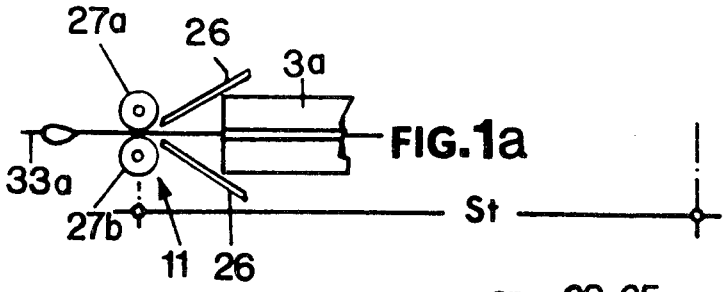
FIG. 1*a* is a plan view of the embodiments of this invention shown in FIG. 1.
Figure 1B:
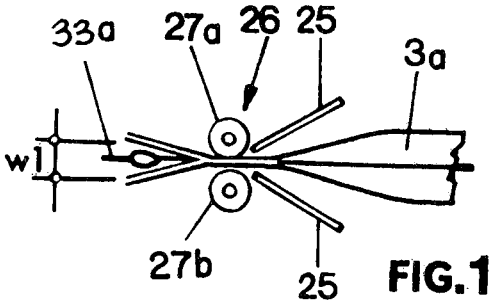
FIG. 1*b* is another view of the embodiment of this invention shown in FIG. 1*a*.
Figure 1C:
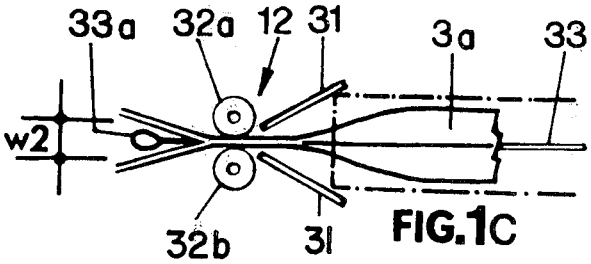
FIG. 1*c* shows another view of the embodiment of this invention shown in FIG. 1.
Figure 1D:
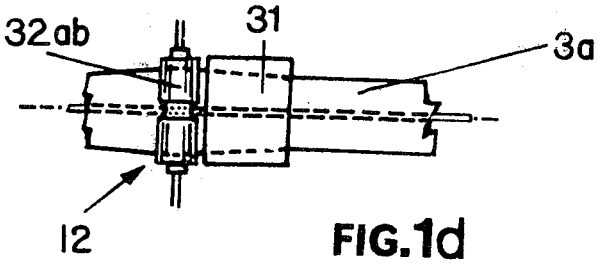
FIG. 1*d* is a plan view of the device of FIG. 1*c*.
Figure 6:
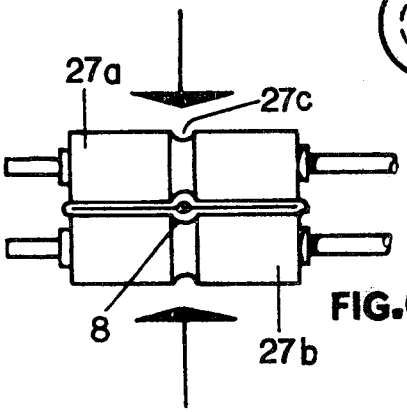
FIG. 6 shows a portion of an embodiment of this invention.
Figure 7:
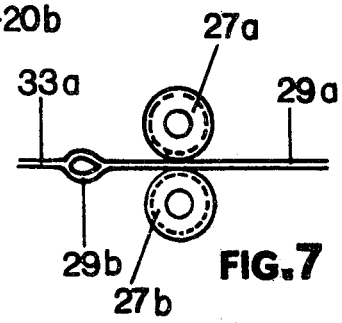
FIG. 7 shows a so-called "runner" in combination with the pair of rolls, in schematic presentation.
Figure 8A:
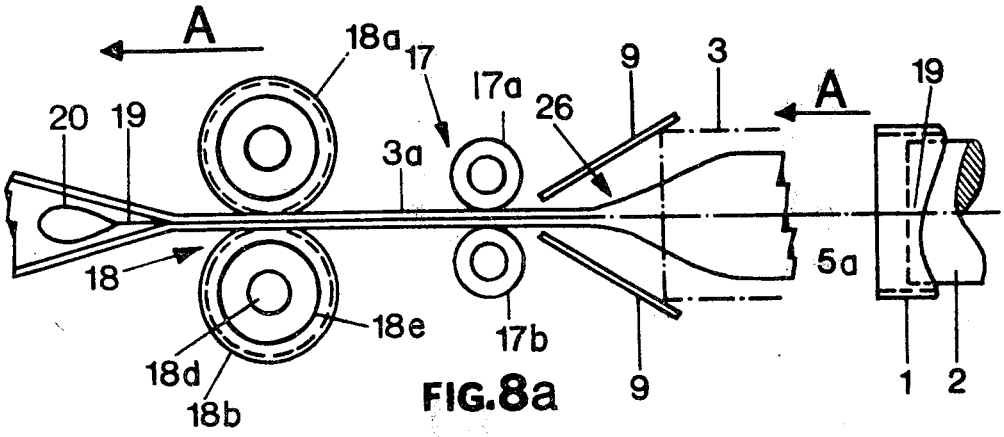
FIGS. 8*a* and 8*b* show a plan view and a sectional side elevational view of the first processing stage of an embodiment of the method according to the invention.
Figure 8B:
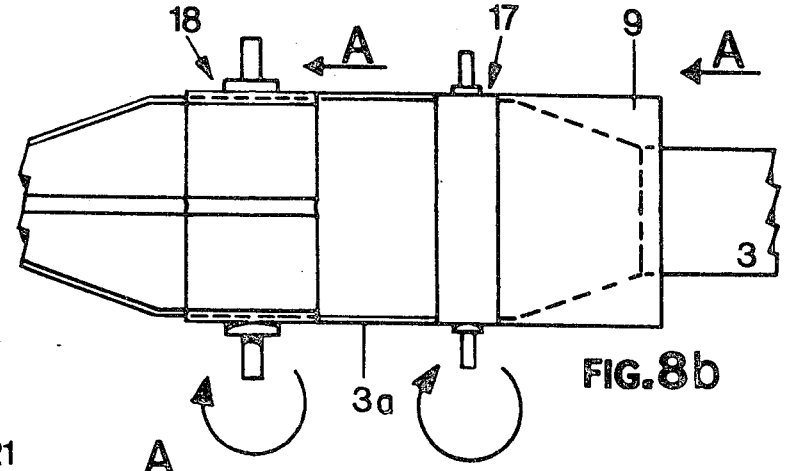
Figure 9A:
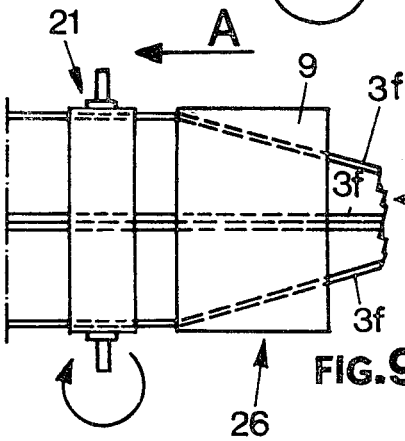
FIGS. 9*a* and 9*b* are schematic views of a second processing stage following the processing stage according to FIGS. 8*a* and 8*b*, with FIG. 9*a* being a plan view and FIG. 9*b* being a sectional side elevational view.
Figure 9B:
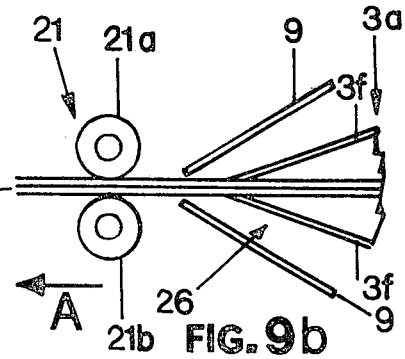

As shown in FIG. 6, rolls 27*a* and 27*b* do not have a continuous, or uninterrupted roll gap or nip. The portion in which another folded or grooved longitudinal seam extends, is provided with recesses or grooves 27*c*, each of which on the one hand define in the area of the roll nip an opening wherein the folds of longitudinal edges 8 are positioned with their "heads" 15 when they pass through said rolls, and which on the other hand enclose or surround guide means 29*a* (FIG. 1) which continues into a guide element 33*a* (FIGS. 1*a* and 1*c*). These guide elements and the longitudinal edges 8 of sleeve 3*a* moving through said recess 27*c* at the same time serve to guide the compressed or flattened sleeve in its longitudinal direction.

Shortly after the rolls 27*a* and 27*b* of the first folding station 11, the guide element 33*a* has mounted thereto a so-called "runner" or "traveller" in the form of a conically tapering body having its pointed end directed towards the nip between the two rolls. As soon as the front end of the flattened sleeve reaches the pointed end of conical body 29*b*, the latter presses the flatly compresssed sidewalls of the sleeve apart from each other, at a specific angle $W_1$ according to FIG. 1*b*. As the guide element 29*a* or 33*a*, respectively, is made of a rigid metallic or steel wire having one end thereof fixed to mandrel 4, this runner 29*b* is always stationarily positioned downstream of the rolls.

Subsequent to the first folding station 11, another folding station 12 is arranged as shwon in FIG. 1*c* wherein the sleeve 3*a* unfolded by the runner 29*b* is compressed or flattened between another pair of folding rolls 32*a* and 32*b* in the other folding direction thereof, after having been introduced into the nip defined between these folding rolls by another funnel 31. Following the flat rolling between the pair of folding rolls 32*a* and 32*b*, a further runner 33*b* slightly opens the flattened configuration of the sleeve 3*a* in order to, on the one hand, retain the resilience for the later unfolding into the polygonal cross-section and, on the other hand, to provide for unrestricted flow of air through the sleeve as is required for drying the inner and outer faces of the sleeve 3*a*. Thereupon, the finished sleeves 3*a* are ready for the subsequent drying step and possibly further processing, within a stacking or piling receptacle. The length of the path of conveyance $R_t$ and of the spacing between the drive assembly 14 and saw 5*a* fully depends on the length of the polygonal sleeves to be produced. Thus, there may be a further simplication of the method if the sleeves are processed in multiple lengths and thereafter, in the finally folded state, brought to their final lengths by punching.

In addition to the above-discussed advantages, the above method further has the benefit that the pressing action in folding stations 11 and 12 results in improved further glueing of the packaging sleeves. The four longitudinal edges 8 (compare FIG. 3) resulting from a rectangular cross-section, particularly due to the use of runner 33*b*, are prefolded in such a way that a certain resilience is retained in longitudinal edges 8, such that the sleeves delivered in an initially flattened state may be easily unfolded into the polygonal configuration by simply exerting finger pressure onto two opposing longitudinal edges 8.

The method illustrated in FIGS. 8*a*, 8*b* and 9*a*, 9*b* proceeds in the direction of arrows A. The finally wrapped sleeve strand 1 is introduced into the apparatus over a feed spindle or mandrel 2. If the sleeve stock 1 has the configuration of a continuously spirally wrapped sleeve strand for which the feed mandrel 2 at the same time forms the wrapping mandrel, the strand is cut into sleeve sections or lengths 3 by means of a cutting or severing device 5, for example, by means of an electronically powered saw 5*a* under the control of a light barrier. If the sleeve stock 1 is introduced into the apparatus already in the form of a tube of a specific length, e.g. as a parallelly or transversely wrapped tube, the preceding division into individual sections can be dispensed with, and such division may be effected only at the end of the method.

The circular or tubular sleeve or section 3 is prefolded at the mouth of a funnel 26 which may comprise a pair of correspondingly inclined guide or baffle plates 9, whereupon the sleeve or section is fed into a first pressing or flattening stage 17 including rubber rolls 17*a* and 17*b* which may be provided with separate drive means in order to advance the sleeve 3. The baffle plates 9 may have associated therewith a device which, during the infeed of the new front end of a tubular sleeve 3, initially moves apart the rubber rolls 17*a* and 17*b* over a slight distance so that the front end of the compressed or flattened sleeve 3 can be received thereby more easily.

Between the rubber rolls 17*a* and 17*b*, the sleeves are subjected to the first method step to form a polygonally shaped sleeve 3*a*, whereby sharp pressed edges are formed at the lateral edges. Then, the sleeve 3*a* from the first pressing stage enters a grooving roller processing means 18, comprising an upper grooving profiled roll 18*a* and a lower grooving profiled roll 18*b* as shown on enlarged scale in FIG. 12 and described in detail. Each roll has an axle or shaft 18*c* including a steel roll core 18*d* mounted which is coated with rubber roll bodies 18*e*. In order to simplify the construction of the grooving profiled rolls 18*a* and 18*b*, these rolls each may be of disc-type construction. These grooving profiled rolls 18*a*, 18*b* carry grooving profiles which are attached to shaft 18*c* or steel roll 18*d* in the form of grooving discs. By this means, the outer edges carry grooving discs 23, whereas inner grooving discs 24 are positioned on the mid portion of the roll surface. The rubber roll bodies 18*e* are mounted on shaft 18*c* between such grooving disc, with one or more spacer discs 24a being disposed between the inner grooving discs 24.

The outer grooving discs 23 are arranged with a spacing from the outer end of the pressed edge corresponding at least to the thickness of the sleeve wall with respect to the sleeve compressed or flattened between rolls 18a and 18b, whereas the inner grooving discs 24 are correspondingly spaced from each other. The rolls 18a and 18b may be constructed from separate discs on the whole, and the rubber roll body 18e, for example, may be composed of rubber discs 18e' and 18e'' as well as 18''', such that the grooving discs 23 and 24 may be spaced with any desired distance between them, in order that various types of sleeves 3a may be produced with different dimensions, thickness and cross-sectional profiles. In this way, re-arrangement or conversion of production programs is substantially simplified, and the production of even small numbers of items can be made economically.

Figure 10A:
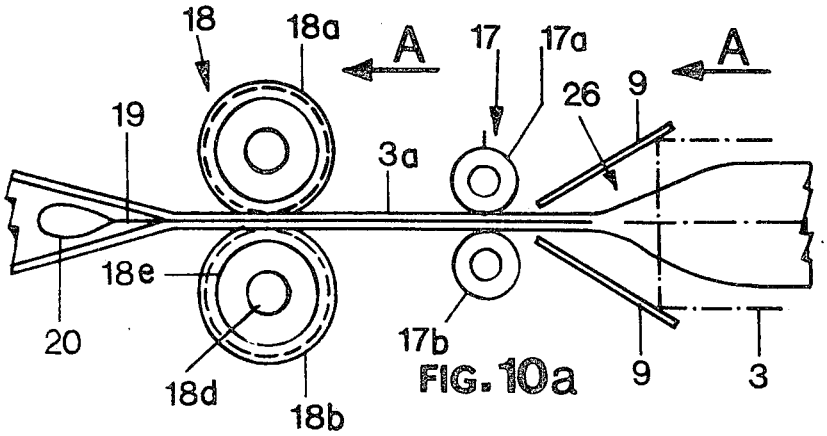
FIGS. 10*a* and 10*b* in combination with FIGS. 11*a* and 11*b* show a modified embodiment of the invention in a presentation similar to FIGS. 8*a* through 9*b*.
Figure 10B:
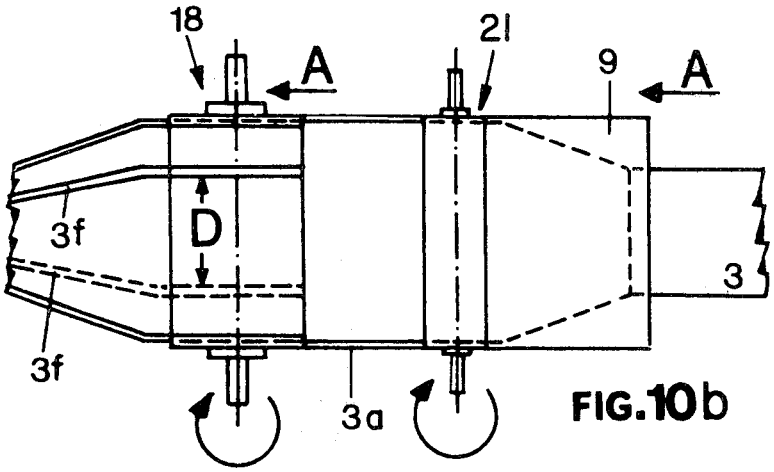
Figure 11A:
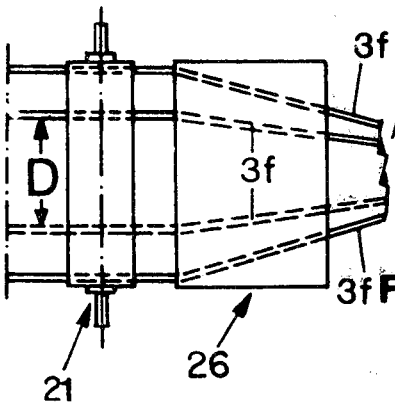
Figure 11B:
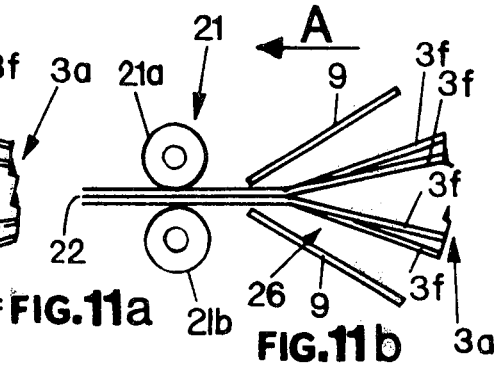
Figure 12:
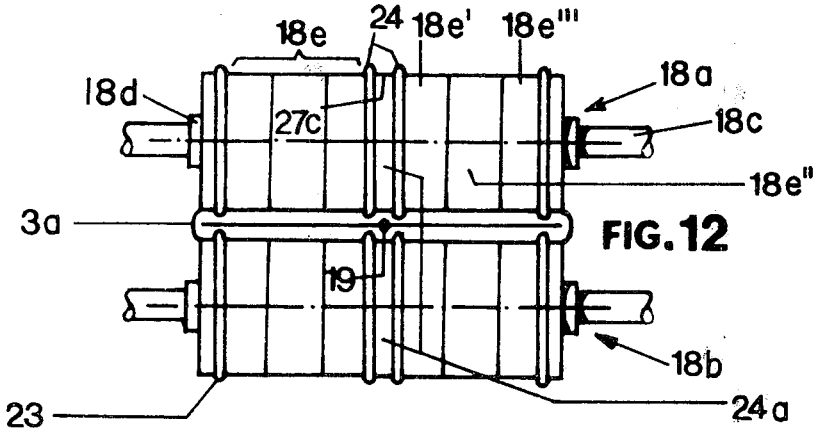
FIG. 12 is a greatly enlarged front view of a pair of profiled rolls of FIGS. 8*a* and 8*b*.

Whereas FIGS. 8a to 9b and 12 and 13 show, as an example, the production of a polygonal sleeve having a square profile, FIGS. 10a and 10b show the production of a rectangular sleeve whereby the inner grooving discs 24 are not positioned directly opposite each other — as shown in FIG. 12 —, but rather staggered relative to each other on rolls 18a and 18b with a spacing D. In this construction, the rolls 18a and 18b each have in the portion of the opposite roll, opposite to one pair of grooving discs 24, back up or backing surfaces which may consist of hard rubber or even metal.

As for the rest, the method according to FIGS. 10a through 11b for the production of a rectangular sleeve does not at all differ from the method shown in FIGS. 8a through 9b, such that identical components of the apparatus are designated by the same reference numerals.

The spacer discs 24a positioned in the space intermediate the inner grooving discs 24 define a recess 27c into which the sleeve wall may readily expand, such that the interior of sleeve 3a defines a small passage for a guide element 19 which, in the form of a metallic wire, (e.g. a steel wire), extends up to the feed portion (FIG. 8a) of the sleeve strand 1 and is secured thereto. This guide element 19, in combination with the inner grooving disc pairs 24, forms a rectilinear guide means for sleeve 3a. On the other hand, this guide means 19, in the direction of movement of sleeve 3a behind the grooving roller processing portion, has secured thereto a conical body 20 which, as means for unfolding, i.e. as a so-called "runner", has its pointed end directed towards rolls 18a, 18b, so as to automatically provide for opening of the flattened sleeve walls when sleeve 3a passes therethrough, after leaving the grooving roller processing means 18.

After the automatic folding over of the once compressed or flattened and subsequently grooved sleeve 3a, the above portion or station 18 is succeeded at a funnel 26 by a second pressing stage 21 which is likewise provided with rubber rolls 21a and 21b. In this second pressing stage, sleeve 3a, for example, of square cross-section is pressed in a direction rotated by 90° relative to the first pressing stage 17, such that the sleeve is finally grooved at 22 and is discharged from the apparatus in a state as folded in both directions. In this case, too, the second pressing stage 21 may be followed by means 20 for unfolding the sleeve 3a such that the sleeve may be dried more readily in a slightly unfolded state.

According to FIG. 13, the finished sleeve 3a has at each corner thereof, curved, pressed or longitudinal edges 3f and, at each such edge, notches or grooves 3c impressed by the inner grooving discs 24. The impressing or compressing of grooves 3c and 3d results in stretching of the flat sides of sleeve 3a such that these flat sides are straightened in addition to the pressing or flattening steps. In addition, impressing of grooves 3c and 3d results in rigid, "head"-like longitudinal edges 3b which provide additional longitudinal reinforcing to the foldable polygonal sleeve. It is essential to the pressing operations and to the impression of grooves that this processing is performed in the still glue-wetted or otherwise moist, deformable state of the sleeve material.

Surprisingly, it has also been found to be possible to provide a foldable polygonal sleeve even without the above-described impressing of grooves into the longitudinal edges of sleeve 3a. Such sleeves of simple construction and manufacture are of satisfactory stability and durability even if they are merely compressed or folded along the pressed edges, such that they may be employed without disadvantage as an inexpensive packaging material.

The finished polygonal sleeves may be manually unfolded into their final polygonal cross-section, and they may be assembled to form a rigid, dimensionally stable packaging unit by inserting thereinto covers which, for instance, are positioned in the front or end openings in recessed fashion.

Figure 14:
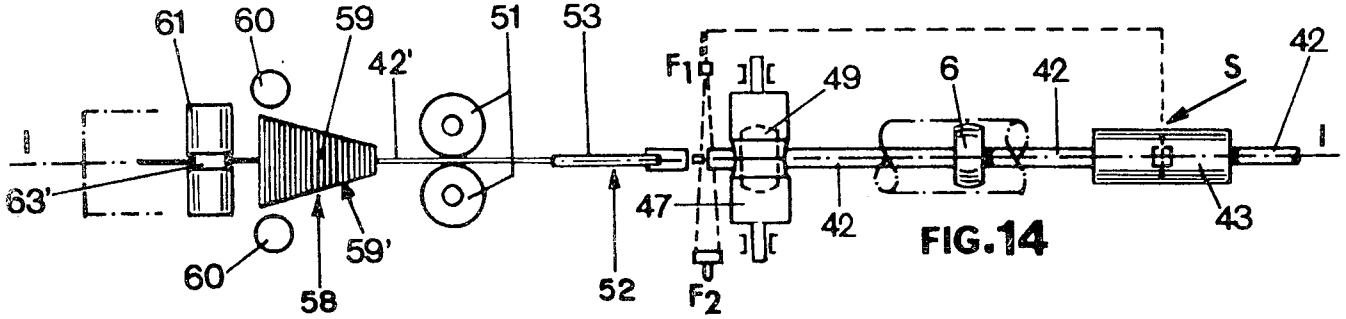
FIG. 14 is a schematical elevation of a modified embodiment of an apparatus according to the invention, namely in a portion I—I following a winding or wrapping device.
Figure 15:
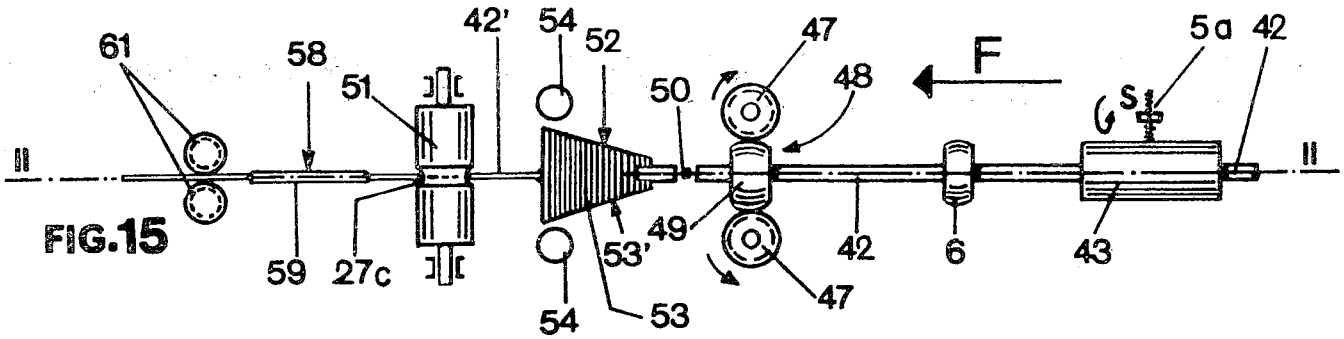
FIG. 15 is a plan view of the apparatus according to FIG. 14, wherein the center longitudinal axis is indicated at II—II.
Figure 16:
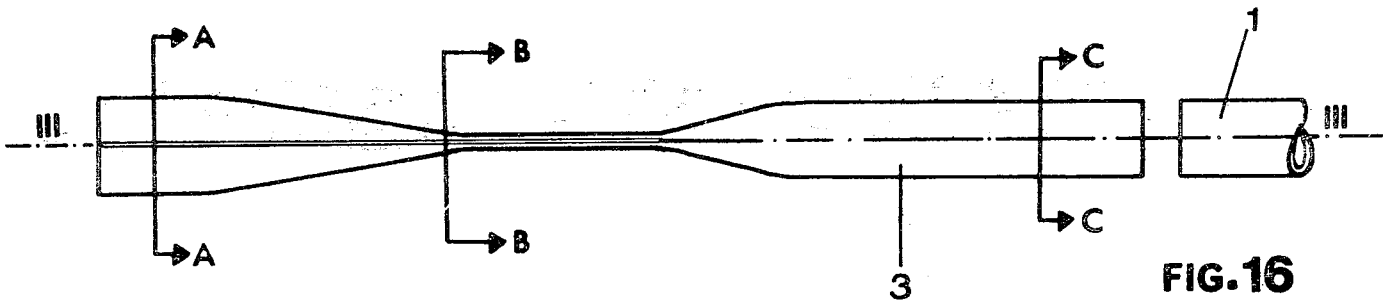
FIG. 16 shows a sleeve in its form as produced, namely in its various states of shaping or deformation, whereby this portion (cross-section III—III) corresponds positionally to the center longitudinal axis I—I of FIG. 14.

The complete apparatus as shown in FIGS. 14 and 15 operates from the right to the left. A central guide bar 42 being secured as a centering device to a (not illustrated) wrapping spindle or mandrel, has mounted thereon a guide block 43 which supports a circular or tubular sleeve strand 1 (corresponding to FIG. 16) inserted into the apparatus from the right hand side at the inner side of such strand. A severing saw applied at S cuts the sleeve strand 1 into individual sleeve sections or lengths (FIG. 16). The separate sleeve sections 3 are engaged at their head or front ends by the rollers 47 of a driving device 48 adjusted to some overfeed, and they are advanced in the material flow direction F. whereby, again, an interior guide or back up element 49 on said guide bar 42. Another guide block 46 may be provided between the guide block 43 at the saw and the driving device 48.

In the flow direction F "downstream" of the driving device 48, the central guide bar 42 is provided with a directing or aligning joint 50 in which the adjacent ends of the central guide bar 42 are radially and pivotally movable relative to each other. In this way, the sleeve sections 3 advanced by said driving 48 may be corrected in their direction of movement relative to their previously estblished center axis so as to be introduced into the following pair of nip or press rolls 51 in a precisely centered fashion.

The aligning joint 50 is followed, on the guide bar 42, by a first aligning or directing means 52 including a flat, spade-shaped metallic plate 53 which is precisely aligned with the longitudinal center axis I (or II) and with the plane of the roll gap or nip defined between the roll axes and which has lateral edges 53' diverging conically outwards towards the rolls.

At the rear end of metallic plate 53', the central guide bar 42 continues to extend in a configuration of slightly smaller cross-section (guide wire 42'), namely through the center point of the roll gap of the pair of rolls 51, whereby symmetrical recesses 55 are provided for this purpose in the mid regions of the individual rolls. Accordingly, the metallic plate 53 is retained or supported at one end by the aligning joint 50 and at the other side by the guide wire 42' being precisely centered between the pair of rolls 51, such that the sleeve sections 3 may be introduced between the press rolls in precisely centered relation thereto.

In addition to the directing means 52 being operative at the inner face of the sleeve sections 3, this device further may include a pair of aligning or directing rollers 54 positioned radially outwards of lateral edges 53'; while the spade-shaped metallic plate 43 successively shapes a sleeve section 3 from the inner side thereof into an elliptical cross-section at a pair of diametrically opposite points, thereby at the same time guiding the sleeve section in centered relation. The aligning or directing rollers 54, which may be formed also as tracks or skids, back up the centered guiding from exteriorly of the sleeve wall so as to stabilize the overall axial length of the sleeve.

As shown in FIGS. 16 and 19, the sleeve section 3, which has initially a round (circular) cross-section, is pre-shaped into a rather flatly elliptical shape by the first aligning or directing means 52, particularly along the diverging lateral edges 53' of metallic plate 53, such that this sleeve section may be engaged at its leading front end by the pair of rolls 51.

In the roll gap between the pair of press rolls 11, the sleeve section 3 is thereafter finally compressed into a flatly folded (flattened) configuration such as shown in FIG. 18, whereby the lateral margins or edges form first folding hinges 57, both in the case of parallel wrapped sleeves and spirally wrapped sleeves.

Owing to the recesses 55 and the stiff guide wire passing therethrough, small crimps or elbows 56 (FIG. 18) or outwardly bent folds are formed exactly along the mid portion of the flattened sleeve section 3, along which crimps or folds not only is the sleeve section **3*a*** guided through the apparatus in centered fashion, but which also form advantageous folding hinges for a foldable packaging sleeve. It should be remembered that at this point the packaging sleeve is still moist from adhesive or glue and relatively easily deformable during the above-described phases of operation, and that the individual wrapping layers do not yet securely adhere to each other.

Thereafter, the first pair of press rolls is followed by a second directing or aligning means 58 which, in the case of a square cross-section of the packaging sleeve, is rotated by 90° on the longitudinal center axis I and II, and the metallic plate 59 of which by means of its diverging lateral sides or edges 59' not only unfolds again the wall of sleeve section **3*a* in a position rotated by 90°, but also preshapes such sleeve, optionally in cooperation with second aligning rollers 60, in a position rotated by 90° with respect to FIG. 18, before a second pair of press rolls 61 folds over the sleeve section as shown in FIG. 17. Due to the recesses 63, this also results in the formation of crimps or elbows 62 in the positions of the folding hinges 57, whereby the guide wire 42' extends up to a point downstream of the second pair of press rolls 61 such as to be held, on the whole, exactly in the longitudinal center axis between the first and second pairs of press rolls. Following the secnd pair of press rolls 61, there may also be provided a device for repeatedly unfolding the sleeve sections 3*a*** which have been rendered to be foldable into a flat configuration.

Downstream of the driving device 48, there may be provided a photocell $F_1$–$F_2$ the light beam of which is adapted to be interrupted by the sleeve portion drawn in by the rollers 47, so as to control operation of the saw. The metallic plates 53 and 59 may be made of a different material than metal, too.

What I claim is:

1. A method of producing a foldably collapsible packaging sleeve of polygonal cross-section, comprising the steps of forming tubular sleeve stock by wrapping a plurality of layers of glued thin material on a stationary mandrel, and, while still in the glue-wetted state, separating said stock into sections and shaping each of said sections into a polygonal cross-section with at least one continuous folding edge impressed into the sleeve wall and extending in the longitudinal direction of said sleeve at each of the longitudinally extending edge corners of the polygonal cross-section, the shaping operation to form the polygonal cross-section being simultaneous with the formation of the folding edges so that the compressing and compacting at each of said edges resulting from being so impressed is accompanied by stretching of the sides of said polygon into a straight condition.

2. The method according to claim 1, wherein, the length dimension of the separated sections is a multiple of the final lengths to be produced, comprising the additional step that the sections are severed (cut) into the final length sections after the shaping into the polygonal cross-section and after formation of the folding edges.

3. The method according to claim 1, wherein the sleeves following the shaping and edge-forming steps are subjected to the additional step of a folding operation in at least one direction parallel with respect to the longitudinal axis of each of said sleeves, whereby said sleeve is brought into a flatly folded configuration.

4. The method according to claim 3, wherein said additional step comprises each sleeve being folded successively at different longitudinal edges.

5. The method according to claim 4, wherein said additional step comprises a sleeve having a rectangular cross-section being successively brought first into an edgewise upright, folded configuration and then into a horizontally folded flat configuration.

6. The method according to claim 3, wherein said sleeves during the successive folding operations are guided along guide means passing longitudinally with respect to and through interior of such sleeves.

7. The method according to claim 1, wherein wrapped sleeve stock after its separation into individual lengths and in a condition still moist from the glue or adhesive is subjected to a press forming step during which the sleeve profile is compressed or flattened from the circular or tubular configuration directly into a flattened configuration with the sleeve walls contacting each other, thereby forming sharp bending edges or folds at the edges of the flattened sleeve wall; and wherein said sleeve is thereupon subjected to the additional step of being unfolded again and flattened by at least one subsequent pressing station in an angular position different from that in the preceding press shaping step, whereby the periphery of said sleeve is shaped by the successive compression or flattening steps into substantially planar surfaces interconnected at their longitudinal edges and defining a polygonal cross-section of said sleeve when the latter is unfolded.

8. The method according to claim 7, wherein at least one of said press forming shaping steps is performed as a rolling operation in the course of which the sleeve is initially compressed into a flat cross-section at its leading front end, and thereafter passed through a pair of rolls in the direction of the longitudinal axis of said sleeve, whereby said sleeve is successively compressed along its full length with flatly contacting sleeve walls.

9. The method according to claim 7, werein in order to produce a sleeve having a rectangular cross-section, the first and second press forming steps are performed under an angle other than 90°.

10. The method according to claim 8, wherein in order to produce a sleeve having a rectangular cross-section, said first and second press forming steps are performed under an angle other than 90°.

11. The method according to claim 8, wherein said unfolding step between said first and second press forming steps is performed progressively during the advance of said sleeve from said first pressing station to said second pressing station.

12. The method according to claim 7 wherein, during at least one of said forming steps, a bulge is impressed into the sleeve wall in at least one of the sleeve wall portions as it is being pressed against each other, which bulge is convexly curved outwards and which extends in parallel with the longitudinal axis of said sleeve and along one of the contemplated folding edges of said sleeve.

13. The method according to claim 1 wherein, during the press forming step, recessed longitudinal grooves are impressed into the sleeve wall along at least one of the longitudinal edges of the desired polygonal cross-section.

14. The method according to claim 13, wherein longitudinal grooves are impressed on either side of and adjacent to a longitudinal edge.

15. The method according to claim 14, wherin said longitudinal grooves are each impressed at the upper and lower sides of the marginal pressed edges, from the outer side into the sleeve wall during a press forming step.

16. The method according to claim 14, wherein said longitudinal grooves are impressed for all longitudinal edges into the sleeve wall during the first press forming step, and wherein the longitudinal grooves which are not positioned adjacent the pressed edges, are impressed into the outer surface of upper and lower side of the flat faces of the sleeve wall in the form of juxtaposed dual grooves.

17. The method according to claim 16, wherein said paired, associated longitudinal grooves are impressed with a relative spacing corresponding at least to the thickness of the sleeve wall.

18. The method according to claim 8, wherein said longitudinal grooves are formed by raised grooving edges or rims which may be provided on the roll surface.

* * * * *